United States Patent [19]

Fields

[11] 3,996,631

[45] Dec. 14, 1976

[54] SAFETY DEVICE FOR USE IN BATHROOMS WITH BATHTUBS

[75] Inventor: Samuel P. Fields, Fordland, Mo.

[73] Assignee: The Raymond Lee Organization, Inc., a part interest

[22] Filed: July 21, 1975

[21] Appl. No.: 597,551

[52] U.S. Cl. ..... 4/185 H; 4/254

[51] Int. Cl.[2] ..... A47K 17/02

[58] Field of Search ..... 4/185 R, 185 H, 185 HB, 4/185 L, 254, 1, 4; 211/105.1, 123; 248/291; 297/390, 284

[56] References Cited

UNITED STATES PATENTS

| | | | |
|---|---|---|---|
| 2,092,426 | 9/1937 | Riddell | 4/185 H |
| 2,319,017 | 5/1943 | Tillman | 4/185 H |
| 2,818,578 | 1/1958 | Cantrell | 4/185 H |
| 3,114,154 | 12/1963 | Laughlin | 4/185 H |
| 3,239,846 | 3/1966 | Smith | 4/4 |
| 3,604,019 | 9/1971 | Garner | 4/185 H |

FOREIGN PATENTS OR APPLICATIONS

| | | | |
|---|---|---|---|
| 1,907,229 | 9/1970 | Germany | 4/185 H |

*Primary Examiner*—Henry K. Artis

[57] ABSTRACT

A vertical telescopic pole extends between the floor and ceiling of a bathroom that contains a bathtub. A side mounted plate with a vertical slot is secured to one side of the pole. A second telescopic pole is pivotally secured at one end to a bathroom wall that is adjacent to the bathtub. The second pole can be pivoted to extend transversely across the bathtub with its free end engaging the slot in the plate of the first pole whereby the second pole is disposed horizontally and can be used as a guide rail. When the second pole is not in use, it can be swung to a vertical position and held there by a clip attached to the wall directly above its pivoted end.

5 Claims, 5 Drawing Figures

SAFETY DEVICE FOR USE IN BATHROOMS WITH BATHTUBS

SUMMARY OF THE INVENTION

This invention is designed to aid invalids and other people get into and out of a bathtub, without presenting an awkward barrier when it is not needed.

In this invention, an elongated telescopic pole extends between the floor and ceiling of a bathroom and carries side mounted pole securing means. A second like pole lacking the securing means is pivotally secured at one end to a bathroom wall adjacent the long side of a bathtub. The second pole functions as a guide rail. When the rail is needed as a handhold to assist someone in entering or leaving the tub (or moving up and down in the tub), it can be pivoted to a horizontal position, extending transversely across the tub. It is held in this position by engaging its free end to the securing means on the first pole. The rail when not in use can be swung into vertical position and held in place detachably by a clip attached to the wall.

Thus, this invention does not present much of a structure to interfere with normal movement in the bathroom, but does provide a handhold adequate to support people entering and leaving the tub (or moving up and down in the tub). The rail can be swung up to a vertical position when the user is in the tub, so that it does not present an obstacle when not needed.

DETAILED DESCRIPTION OF THE PREFERRED EMBODIMENT

Figure 1:
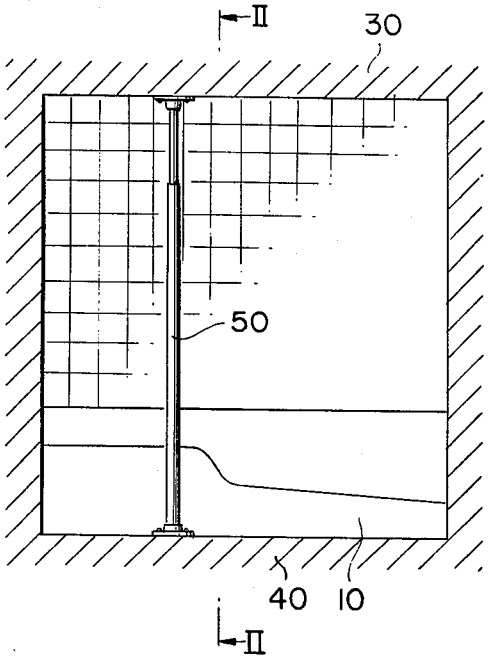
FIG. 1 is a side view of the invention.
Figure 2:
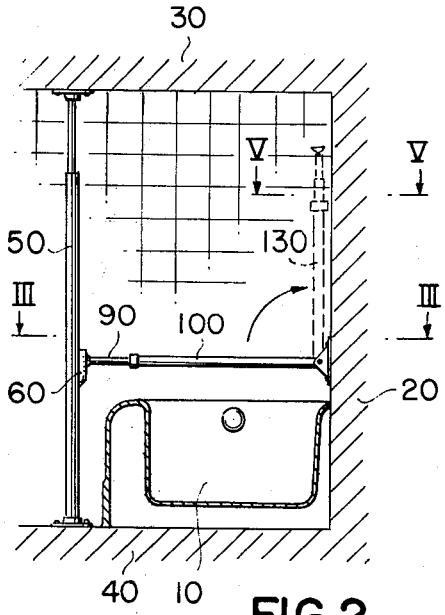
FIG. 2 is a front view of the invention.
Figure 3:
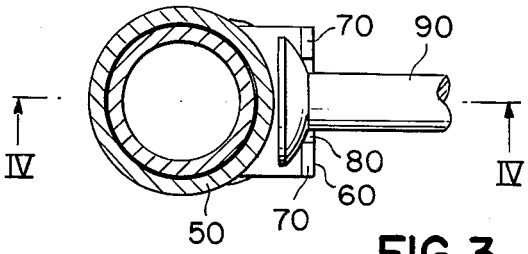
FIG. 3 is a view along Line III—III of FIG. 2.
Figure 4:
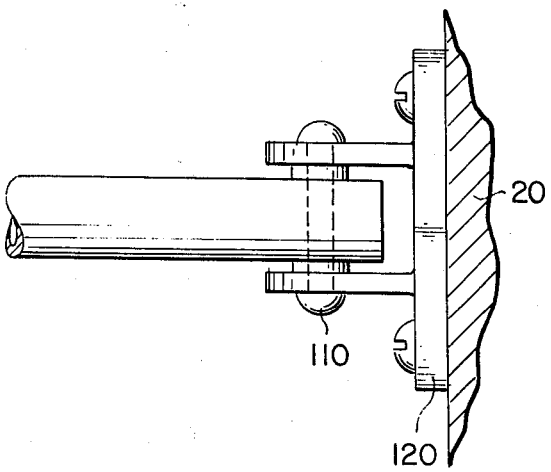
FIG. 4 is a side cross-sectional view of the left side of FIG. 3.
Figure 4:
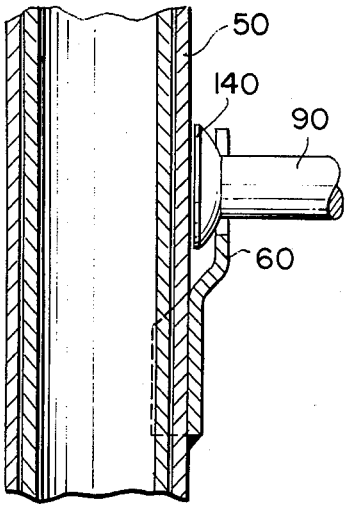
Figure 5:
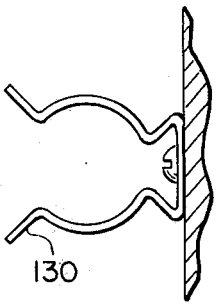
FIG. 5 is a view along line V—V of FIG. 2.

FIGS. 1 and 2 show a bathroom in which a bathtub 10 is located. One of the walls 20 of the bathroom abuts the longitudinal edge of the tub, or it adjacent to it.

Between the ceiling 30 and floor 40 of the bathroom extends an elongated vertical telescopic pole 50. A bracket 60 is attached to the pole, and has two like vertical flanges 70 separated by a vertical slot 80.

Into this slot may be introduced the free end 90 of an elongated, telescopic rail 100. One end of the rail is pivotally secured to wall 20, because horizontal axle 110 passes through the rail and is attached to bracket 120 that is fixed to the wall. When the rail is supported by bracket 60 and the pole, it is in a horizontal orientation, extending transversely over the tub. It can be pivoted upwardly, out of the way, to be held in a vertical portion by clip 130 that is attached to wall 20 directly above bracket 120.

The free end of the rail supports a disc like member 140. Bracket 60 extends slightly outwardly from the pole and the member slips into that space, preventing the rail from contracting and slipping out of the bracket.

Although the invention has been described with particular reference to the drawings, the protection sought is to be limited only by the terms of the claims which follow.

I claim:

1. A safety device for use in bathrooms with bathtubs, comprising:

an elongated, vertical, pole extending between the floor and ceiling of the bathroom near the bathtub;

an elongated rail hingedly attached at one end to a bathroom wall adjacent the bathtub so as to be pivotable in the vertical plane that includes the pole and extends transversely across the tub;

a bracket attached to the pole to support the free end of the rail when the rail is pivoted to a horizontal position; and a clip attached to the bathroom wall directly above the hinged end of the rail to detachably secure the rail in a vertical position.

2. The device of claim 1 wherein the free end of the rail supports a disc-like member that detachably engages the bracket.

3. The device of claim 2 wherein the pole is telescopic.

4. The device of claim 3 wherein the rail is telescopic.

5. The device of claim 4 wherein the bracket has a vertical slot slidably engaged by said member.

* * * * *